US006246371B1

(12) United States Patent
Kurz et al.

(10) Patent No.: US 6,246,371 B1
(45) Date of Patent: Jun. 12, 2001

(54) WIDE BAND ANTENNA MEANS INCORPORATING A RADIATING STRUCTURE HAVING A BAND FORM

(75) Inventors: Hans-Peter Kurz, Akersberga; Mattias Hellgren, Taby; Annika Yidong Hu, Akersberga, all of (DE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/285,006

(22) Filed: Apr. 1, 1999

(30) Foreign Application Priority Data

Apr. 2, 1998 (SE) ..... 9801169
Dec. 22, 1998 (SE) ..... 9804498

(51) Int. Cl.[7] ..... H01Q 1/38
(52) U.S. Cl. ..... 343/702; 455/90
(58) Field of Search ..... 343/702, 803, 343/806, 798, 895; 455/575, 90

(56) References Cited

U.S. PATENT DOCUMENTS 3,355,740 * 11/1967 Mayes ..... 343/806
4,313,119 1/1982 Garay et al. ..... 343/702
4,571,595 2/1986 Phillips et al. ..... 343/745
5,408,699 * 4/1995 Yamashita et al. ..... 455/274

FOREIGN PATENT DOCUMENTS 0509339 10/1992 (EP) .
WO91/15621 10/1991 (WO) .
WO97/18600 5/1997 (WO) .

* cited by examiner

*Primary Examiner*—Don Wong
*Assistant Examiner*—James Clinger
(74) *Attorney, Agent, or Firm*—Jacobson, Price, Holman & Stern, PLLC

(57) ABSTRACT

An antenna means (2) for transmitting and receiving RF signals, comprising: a ground plane (11) arranged to be connected to ground of the circuitry of a radio communication device and a conductive radiating structure (20) in the form of a band. The radiating structure has in a first end a feed portion (21) arranged to be coupled to circuitry of a radio communication device. The radiating structure has a second end which is a free end (29). The band has a first (A) and a second (B) surface, and is divided by bent portions into a number of sections $S_n$ along its length. The band is bent or folded so that the first surface (A) of a first section $S_1$ faces the first surface (A) of a second section $S_2$, being adjacent to the first section $S_1$, and the second surface (B) of a section $S_m$ faces the second surface (B) of a consecutive section $S_{m+1}$, whereby a compact antenna means which can operate within a wide frequency band is achieved.

15 Claims, 10 Drawing Sheets

WIDE BAND ANTENNA MEANS INCORPORATING A RADIATING STRUCTURE HAVING A BAND FORM

FIELD AND BACKGROUND OF THE INVENTION

The invention relates to an antenna means for transmitting and receiving RF signals having a radiating structure with a band shape. Specifically, it relates to an antenna device for a mobile radio communication device, e.g., a hand-portable telephone or a car radio antenna, which is capable of both transmitting and receiving on multiple separate frequency bands. This would increase the probability of the telephone being operable for communication in a site where service is available within more than one band. Such a telephone may be a terminal in, e.g., a GSM, PCN, DECT, AMPS, PCS, and/or JDC cellular telephone system, possibly having an additional pager function or other radio facilities. The frequencies included in the multiple bands of the invention do not need to have any fixed relationship to one another and may thus have arbitrary separations.

The invention also relates to an antenna means which is compact, and requires a small space. For mobile radio communication devices, and especially hand-portable telephones there is a demand for small and efficient antenna means, to decrease the weight and to occupy less space.

RELATED ART

Antenna means having a band shaped radiating structure are known. For example, WO 91/15621 discloses an antenna structure in which the antenna is a foil having helical shape which is supported by winding it on a hollow cylindrical braid. The foil and the braid cylinder are potted in a resin. This antenna structure demands a quite large amount of space, which makes it unpractical for use in small hand-portable telephones or where there is a need for small and efficient antenna means. Further its manufacture is rather complicated.

EP-A1-0 509 339 discloses an antenna with top capacitance for use with mobile radio telephones. The antenna system has a counterweight base with the antenna formed by a top capacitor that has an S-shaped coil connection and a contact point. The top capacitor, having U-shape, is formed as a flexible foil with a substrate having a printed circuit pattern.

An antenna of this kind has the disadvantage that, with the top capacitance, it is difficult to achieve a desired electrical/physical length of the antenna. Therefore, a complicated feeding arrangement is needed, or the device cannot operate in lower frequency bands, especially in the frequency range of 875–960 MHz, where the physical length corresponding to 0.25 $\lambda$ is about 80 mm. Furthermore, the described feeding arrangements cause undesired losses. The geometrical shape is further limited to a U-shape.

SUMMARY OF THE INVENTION

A main object of the invention is to provide a wide band antenna means for transmitting and receiving RF signals, comprising: an antenna means for transmitting and receiving RF signals, comprising: a ground plane means arranged to be connected to ground of the circuitry of a radio communication device; a conductive radiating structure having band shape; the band having a first and a second essentially parallel, closely spaced and opposed surfaces; the radiating structure having in a first end a feed portion arranged to be coupled to circuitry of the radio communication device, and; the radiating structure having a second end being a free end, which antenna means is capable of transmitting and receiving RF signals in each one of a plurality of frequency bands, and requiring a small space.

Specifically the antenna means is intended as a single, sufficient antenna means to fulfil the requirements under normal operating conditions of a portable or mobile radio device capable of both transmitting and receiving in multiple frequency bands.

Another object of the invention is to provide a wide band antenna means which exhibits high efficiency in the different frequency bands, and radiation lobe pattern without significant "dead angles".

It is a further object of the invention to enable directional radiation characteristics and improved gain pattern by selecting a combination of geometries of the radiating structure and the ground plane means.

Yet another object of the invention is to provide a wide band antenna means compact and durable enough for portable or mobile radio equipment, including automobile antennas of built-in type.

Still another object of the invention is to provide a wide band antenna means which is suited for manufacturing costeffectively in large quantities.

These and other objects are attained by an antenna means for transmitting and receiving RF signals. The antenna includes a ground plane arranged to be connected to the ground of the circuitry of a radio communication device. There is a conductive radiating structure having a shape of a band wherein the band has a first A surface and a second B surface which are essentially parallel, closely spaced and opposed surfaces. The radiating structure has, in a first end, a feed portion arranged to be coupled to circuitry of the radio communication device. Also, the radiating structure has a second end which is a free end. The band is divided by bend portions to form a number of sections ($S_n$) along its length. The first surface A of a first section ($S_1$) faces the first surface A of a second section ($S_2$) which is consecutive to the first section ($S_1$), and the second surface B of a section ($S_m$) faces the second surface B of a consecutive section ($S_{m+1}$).

The antenna means includes the first surface A of at least a further section ($S_i$) which is facing the first surface A of a consecutive section ($S_{i+1}$). Also, the second surface B of at least a further section ($S_k$) faces the second surface B of a consecutive section ($S_{k+1}$). The second surface B of the second section ($S_2$) is facing the second surface B of a third section ($S_3$), and it is adjacent to the second section ($S_2$). Accordingly, for every section, the first surface A faces the first surface A of an adjacent section.

An angle is formed between at least one tangent line of each pair of surfaces facing each other. The angle between and inclusive of 0°–90°.

According to the invention, the feed portion, being a part of the band, extends in a direction essentially perpendicular to the ground plane means.

The antenna means includes a consecutive section ($S_j$) which is located further away from the feed portion than the previous section ($S_{j-1}$).

In the present invention, the conductive band has a central longitudinal axis, and the central longitudinal axis of the band extends essentially parallel with the ground plane.

Alternatively, the conductive band has a central longitudinal axis wherein the band is bent, between consecutive sections, and around bending axes which are essentially perpendicular to the longitudinal axis in the respective section.

Additionally, the conductive band can have a central longitudinal axis wherein the band is bent, between consecutive sections, around bending axes so as to provide an angle $\beta>0°$ between the longitudinal axis in the respective consecutive sections.

In the invention, the ground plane is a part of the radio communication device. In other words, the housing and the ground plane has a conductive plate.

According to the invention, the band is of such a thickness that the radiating structure is self supporting. Also, the band is supported by a dielectric carrier, e.g., a dielectric band or body.

The antenna means includes that each section can be divided into a concave and a convex portion.

In the invention, the band can be provided with a slit between each section. Each of the slits extends from one edge of the band towards the opposite edge. The band is conductively interrupted between the sections by the slit except for a portion adjacent to the opposite edge. Accordingly, the slits extend alternately from opposite edges of the band along the length of the band.

Also, the band can have an increasing or decreasing width along its length. In one embodiment, the width w of the band in each section is greater than the length 1 of the respective section. In another embodiment, the width w of the band in each section is smaller than the length 1 of the respective section. Additionally, the angle between two consecutive sections, and the width w of the band in the respective sections are selected in order to achieve a sufficient capacitive coupling.

There is a matching means coupled to the feed portion and to be coupled to the circuitry of the radio communication device. This is to provide the antenna which has an impedance, preferably of 50 ohm, to be matched to the circuitry of the radio communication device.

The radiating structure has a flexibility so as to enable it to be compressed. At least two of the sections are connected to each other, in order to short-circuit the radiating structure, and thus making it inoperative. Further, the radiating structure can be expanded to disconnect the connection between the sections, in order to make the antenna means operative. The radiating structure has such a stiffness so as to enable the radiating structure to be compressed, and further expanded by a spring force. In another embodiment, the radiating structure is stiff and made inoperable by means of a conductive member connecting preferably every section. The conducting member is removable in order to render the radiating structure operable, and each section includes a plane portion.

In the embodiments, the band has a thickness, and a width which is at least five times the thickness. The feed portion, being a part of the band, extends in a direction essentially perpendicular to an edge of the ground plane means. Additionally, the band is branched off at a portion between first and the second ends, so as to exhibit a band portion having a third end being a free end. Accordingly, a section of the band is essentially planar and the band is curved in a U-shape in the section.

The antenna means also includes the support which is provided at least partly by at least one strut. The strut is conductive and acts as reactive load to match the radiating structure to a desired impedance of the feed portion. Also, at least one of the struts is non-conductive.

The invention includes the radiating structure connected to the ground plane via a matching means and being at least one in a group consisting of a matching element with inductive characteristics and a matching element with capacitive characteristics. Additionally, the connection means is for the matching means. The matching means is incorporated in a supporting strut.

In the invention, the matching means is connected to the printed circuit board. The board being a first part of the ground plane means, and being capacitively coupled to a second part of the ground plane means. The second part of the ground plane means includes at least a conductive portion of a vehicle body.

The invention also contemplates an antenna assembly including the antenna means wherein the assembly has at least one further radiating structure for at least receiving circularly polarized radio frequency signals, for instance, a GPS antenna.

Through the arrangement of a meandering or zigzag shaped radiating structure in band form, is achieved an antenna means which is operable within a very wide band. A voltage standing-wave ratio, VSWR<1:3.5 can be obtained for 60–70% of the frequency band between the highest operating frequency, e.g. 2.2 GHz, and zero.

By the features recited it is also achieved an antenna means which can operate in a wide frequency band without complicated matching means.

By the features recited it is also achieved an antenna means which has good 360 degrees gain characteristics.

By the features recited it is also achieved an antenna means which is suitable for cost effective production in large quantities. The conductive portion of the radiating structure can be manufactured by steps of stamping, bending, depositing, taping, gluing, etching, or by using MID technology, in which processing accuracy can be obtained to improve mechanical tolerances. This results in a normal standard deviation in mass production.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF PREFERRED EMBODIMENTS

Figure 1:
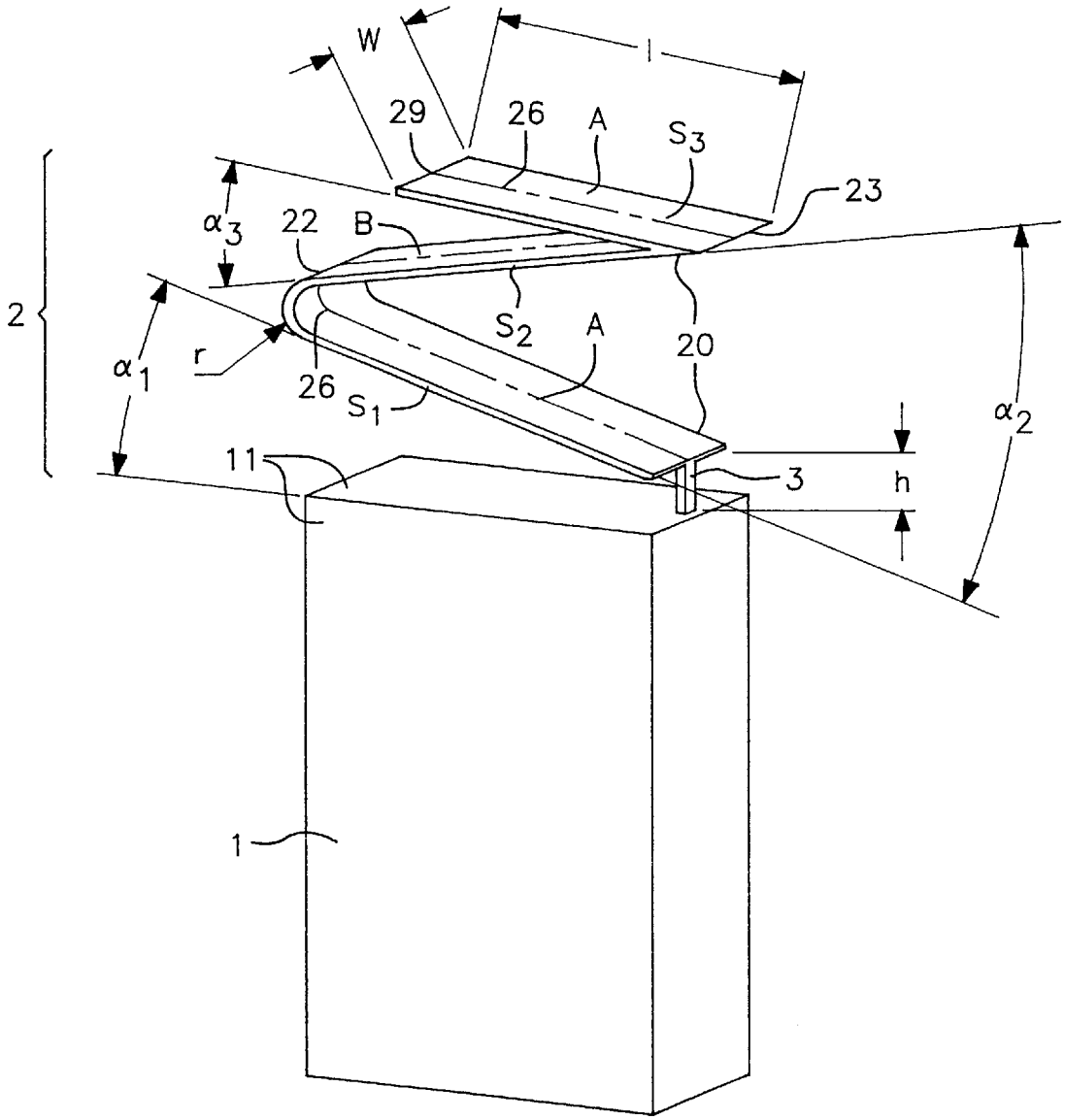
FIG. 1 is a diagrammatic view of a hand portable cellular telephone, provided with an antenna means according to a first embodiment of the invention.

With reference to FIG. 1, a radio communication device, in the form of a hand portable cellular telephone 1, provided with an antenna device 2 according to the invention is diagrammatically shown. The antenna device comprises a ground plane 11, a radiating structure 20, a feed portion 3 and possibly an impedance matching means (not shown). The housing of the telephone may be conductive providing shielding to the PCB('s) of the unit, and connected to signal ground. Non conductive plastic material (not shown) might cover the antenna means and the housing. The ground plane 11 is formed by the housing or a portion thereof of the telephone 1, which is connected to the signal ground of transceiver circuits of the telephone. The ground plane could alternatively be a conductive plate, conductive foil or a printed circuit board. The feed portion 3 is connected, at one end, to the transceiver circuits (not shown) of the telephone, possibly via a matching means. The matching means is used for providing a predetermined impedance, preferably 50 ohm, of the antenna device, towards the transceiver circuits of the telephone. At its other end, the feed portion 3 is connected to the radiating structure 20.

The feed portion is a conductive body at which the radiating structure is fed with an RF signal. It may be a part of a wire of a coil or an elongated radiator, a part of the radio communication device, and/or a body arranged between the radiating structure and the radio communication device.

The radiating structure 20 has the shape of a band having bends or curves in the portions 22, 23. A band, in the context of this disclosure, should be understood to be a thin band, having a first and a second essentially parallel closely spaced and opposed side surfaces, and two edges. The band in the radiating structure according to the invention has a width w being at least three times, preferably five times, as large as its thickness, and preferably not being less than 1–2% of the total length of the band. A suitable width w is in the range 2–50 mm, preferably 4–20 mm at a length of e.g. 100–200 mm to operate at least within a frequency band ranging from 1 GHz to 2 GHz. The band is encompassed by at least one dielectric which could be air or another dielectric. Different dielectric could be in contact with the band on the first and the second side surfaces.

The band has a first surface A and a second surface B, and is divided into sections $S_1$, $S_2$, $S_3$ by the bent portions 22, 23. It is bent so that the surface A in a first section $S_1$ faces the surface A in a second section $S_2$, while the surface B in the second section $S_2$ faces the surface B in a third section $S_3$. By two surfaces facing each other, is meant in this context that the angle between one (longitudinal) tangent line of each of the two surfaces is in the range 0°–90°, preferably 0°–45°. In the case the surfaces A, B are plane, it will be the angle in the bends between consecutive sections of the band. When said angle between the tangent lines is zero, the tangent lines are parallel, which also could be the case for the surfaces (or sections). The so shaped radiating structure 20 can thus be said to have a meandering or zigzag extension. The reference numeral 26 denotes a longitudinal direction of the band.

As seen in FIG. 1 the bend can be a smooth curve having a radius r, to give an angle $\alpha_2$ between the plane sections $S_1$ and $S_2$, as in the portion 22 or a fold as in portion 23. Either of those types of bends are possible. The angle between the ground plane 11 and the first section $S_1$ is denoted $\alpha_1$, and the angle between the sections $S_2$ and $S_3$ is denoted $\alpha_3$. The width w of the band is essentially the same along the length of the band, according to this embodiment. It is important that the width is sufficient, in order to obtain a desired capacitance coupling between the sections and a desired broad bandwidth. Also the angle $\alpha$ affects the capacitive coupling. In an environment where space is limited it could be advantageous when $\alpha_1>\alpha_2$ and $\alpha_1>\alpha_3$. The length of the band is also important for the performance of the antenna means. When the antenna means is to be made very compact the angles $\alpha_n$ are preferably made small to decrease the total height. Due to the increased capacitive coupling between the sections in such a case, the number of sections must be increased, in order to maintain the electrical length. This is made at the expense of the bandwidth, which will slightly decrease. The length of each section, whereof only the length 1 of section $S_3$ is indicated, can be the same or vary. In the figure the length of each section is shown to be greater than the width. However, the opposite could also be the case, and then the number of sections probably have to be increased. The vertical separation of the sections may thus increase, decrease, alternate, or stay the same towards the free end of the radiating structure, providing differences in antenna characteristics.

The feed portion 3 has a predefined length and separates the feed point 21 of the radiating structure 20 from the ground plane 11 with the distance h.

The radiating structure 20 can be made of a conductive band, having a thickness enabling it to be self supporting. Alternatively, it can be provided with a dielectric support also in the form of a band. The radiating structure 20 could also be a conductive layer on a dielectric support in the form of a band or a supporting body. The band can be formed by bending, stamping, etching or depositing.

Figure 2:
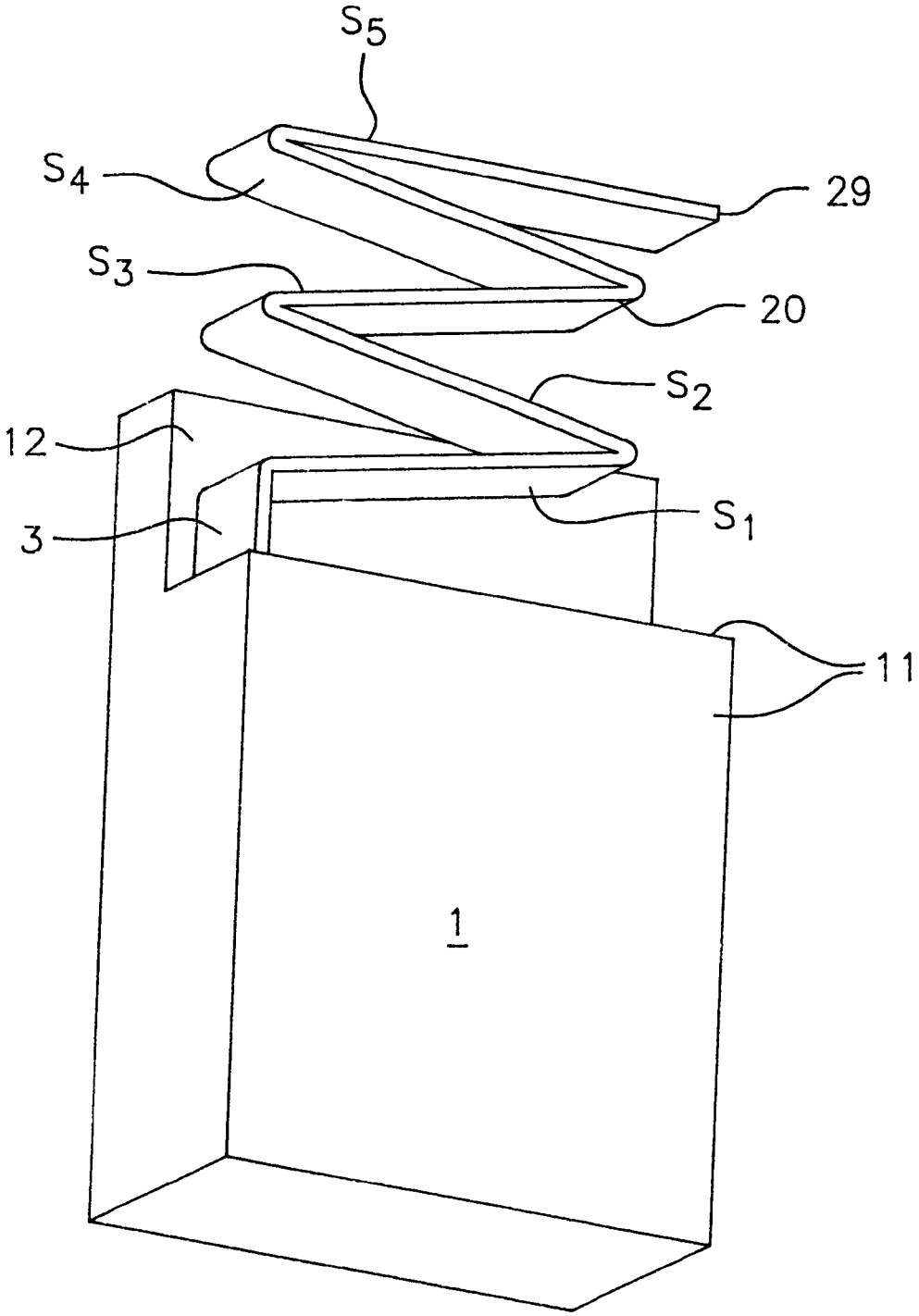
FIG. 2 is a diagrammatic view of a hand portable cellular telephone, provided with an antenna means according to a second embodiment of the invention.

FIG. 2 shows diagrammatically a hand portable cellular telephone 1, provided with an antenna means 2 according to a second embodiment of the invention seen obliquely from below and sideways. This radiating structure 20 includes five sections, and the feed portion 3 is a unitary continuation of the band shaped radiating structure 20. The ground plane can be formed of the part 11 of the housing of the telephone 1 below the radiating structure 20, as in the previous embodiment. Alternatively, it can be formed of a part 12 of the housing of the telephone 1 extending parallel with the radiating structure 20, or both 11 and 12.

Figure 3:
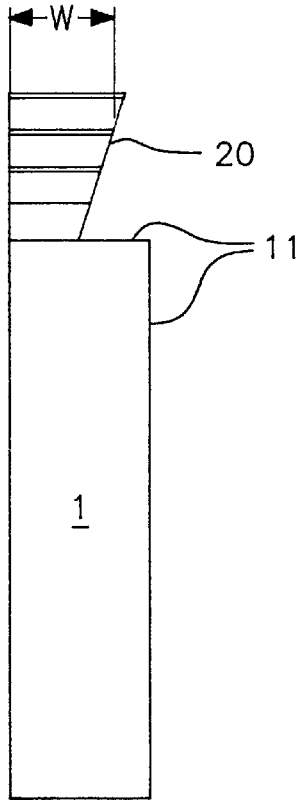
FIG. 3 is a diagrammatic side view of a hand portable cellular telephone, provided with an antenna means according to a third embodiment of the invention.

FIG. 3 shows diagrammatically a hand portable cellular telephone 1, provided with an antenna means 2 according to a third embodiment of the invention, in a side view. From this figure it is seen that the radiating structure 20 has a greater width in the top, at the free end 29, than in the bottom where it is connected to the feed portion 3. This can be made by giving the band shaped radiating structure 20 an increasing width continuously or step by step along its length.

Figure 4:
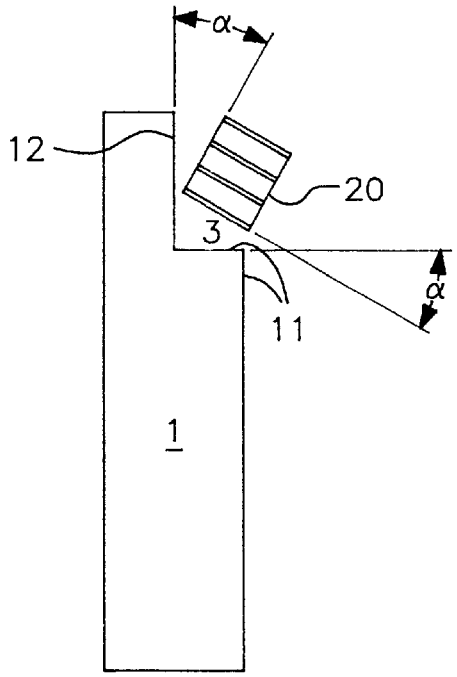
FIG. 4 is a diagrammatic side view of a hand portable cellular telephone, provided with an antenna means according to a fourth embodiment of the invention.

FIG. 4 shows diagrammatically a hand portable cellular telephone 1, provided with an antenna means 2 according to a fourth embodiment of the invention, in a side view. In this embodiment, the radiating structure 20 is tilted an angle $\gamma$ in relation to the ground plane. In this embodiment, the ground plane can be formed of the part 11 or the part 12 of the housing of the telephone 1, or both parts 11 and 12.

Figure 5:
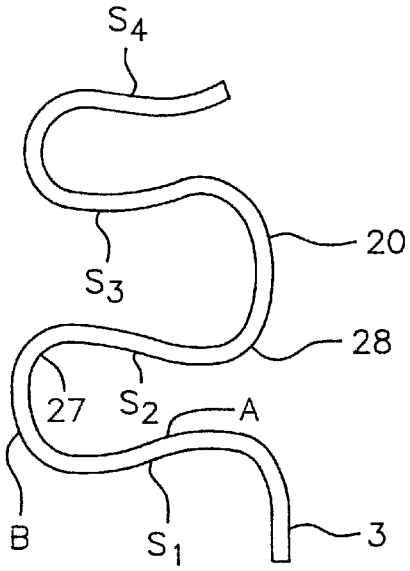
FIG. 5 is a longitudinal section of a radiating structure of a fifth embodiment according to the invention.

FIG. 5 is a longitudinal section of a radiating structure 20, of a fifth embodiment according to the invention. In this embodiment, the radiating structure 20 is meandering so as to provide convex 28 and concave 27 portions of each section $S_n$ and surface A, B.

Figure 6:
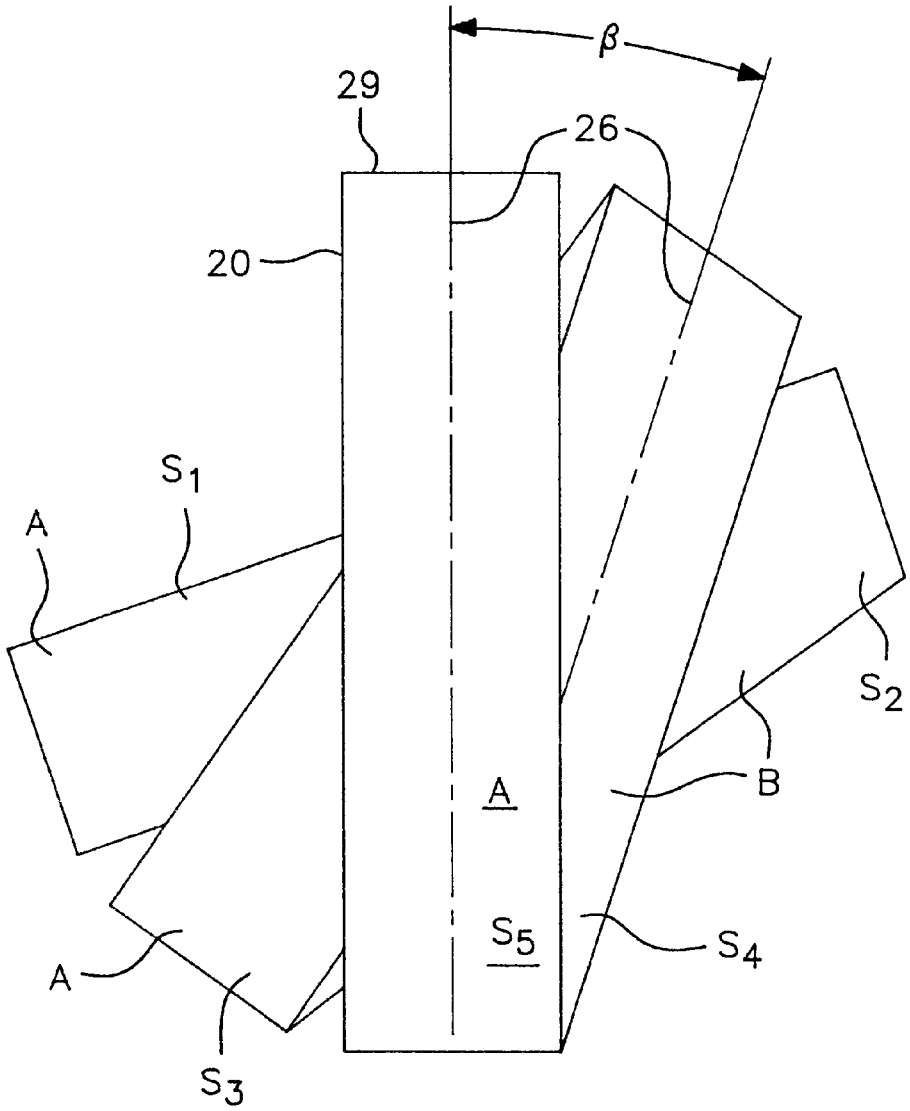
FIG. 6 is a top view of a sixth embodiment of a radiating structure according to the invention.

From FIG. 6, which is a top view of a sixth embodiment of a radiating structure 20 according to the invention, it is seen that the band is bent or folded so that an angle $\beta>0°$ between the longitudinal axis 26 of the band in the respective consecutive sections is provided. Only the angle $\beta$ between the longitudinal axis 26 of sections $S_4$ and $S_5$ is shown. The corresponding angle between the other sections could be the same or vary.

Figure 7A:
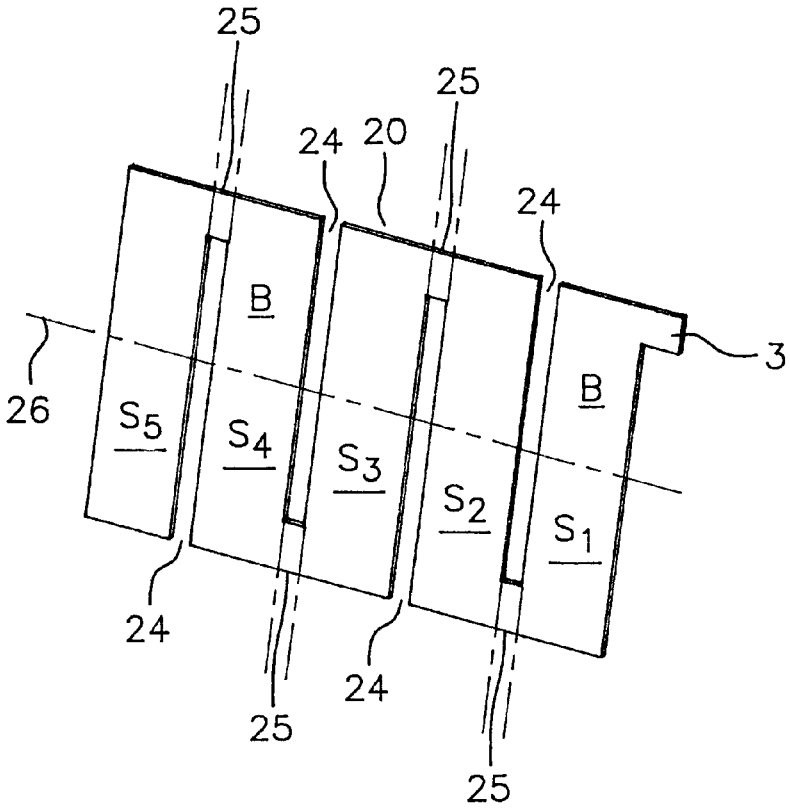
FIGS. 7*a–b* show views of a radiating structure of a seventh embodiment according to the invention.

FIG. 7*a* is a view of a folded up radiating structure 20 of a seventh embodiment of a radiating structure 20 according to the invention. The band has slits 24 in the portions between the sections. Each slit 24 extends from one edge of the band towards the opposite edge, whereby the band is conductively interrupted between the sections by the slit 24, except for a portion 25 adjacent to said opposite edge, which portion 25 preferably include the bent portion. Preferably the slits extend alternately from opposite edges of the band along the length of the band. It is advantageous when the band includes a dielectric carrier, preferably a continuous band, to support the conductive part of the band, which then will be the only part of the band having slits 24.

Figure 7B:
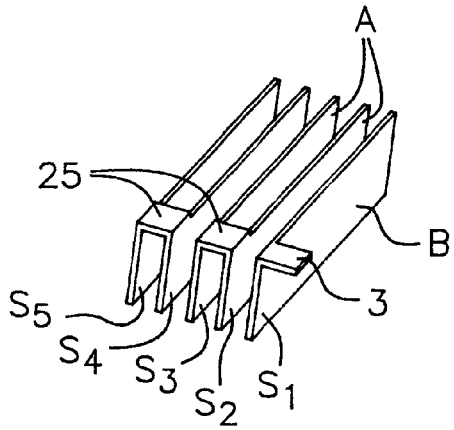

FIG. 7*b* is a view of the radiating structure 20 of the seventh embodiment of a radiating structure 20 according to the invention when folded as in operation.

The radiating structure 20 of the invention, can preferably be manufactured by a stamping, possibly perforating and bending technology. Stamping and bending a radiating structure is an inexpensive production method with tight tolerances for large quantities.

Figure 8:
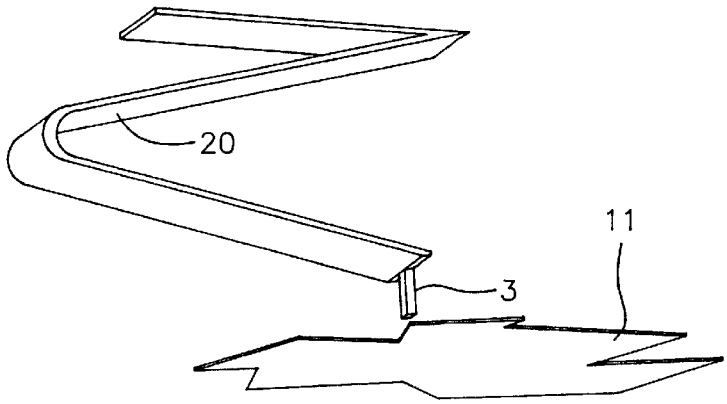
FIG. 8 is a view of a radiating structure with a feed portion and a ground plane of an eighth embodiment according to the invention.

FIG. 8 is an exploded view of a radiating structure 20 with a feed portion 3 and a ground plane 11, for an antenna means suitable to be built in or placed in a small volume or compartment, i.e. in a car. In such an application, the dimensions and the number of sections can be selected so as to enable the antenna means to fit in the available space.

The radiating structure 20 according to the invention, may be manufactured by MID-technology. This is an advantageous manufacturing method for an antenna device according to the invention. A flexible printed circuit board carrying the radiating structure 20, and possibly the feed portion 3, possibly together with a flexible printed circuit board carrying the ground plane 11 is inserted and formed (bent) in a tool (mould) into which a dielectric is injected, and further hardened. Through this process a compact and durable antenna means is achieved by a simple and cost-effective manufacturing process, suitable for production in large quantities.

Figure 9:
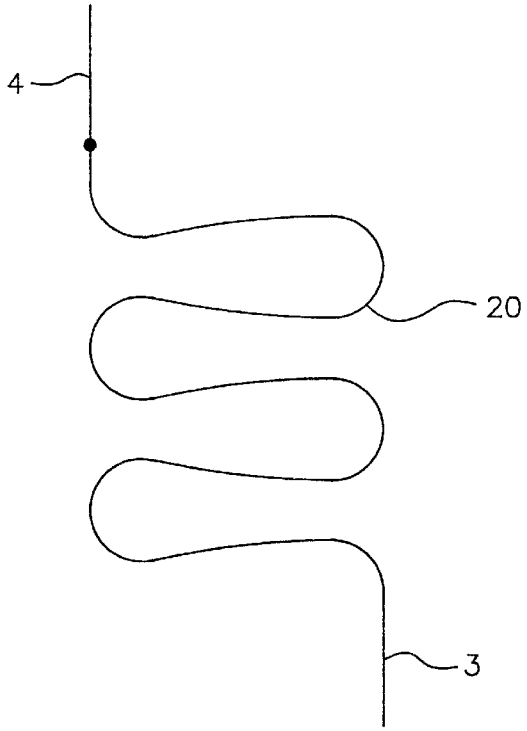
FIG. 9 is a diagrammatic side view of a radiating structure according to the invention, being used as an emergency antenna means.

FIG. 9 shows a radiating structure 20 according to the invention, which is to be used as an emergency antenna. When not in use, the antenna is folded so that parts of adjacent sections contact each other, and possibly short circuit the antenna, and thereby makes it inoperative. To achieve this the radiating structure 20 must be flexible. The radiating structure 20 is preferably provided near its free end with an attachment means 4, e.g. a string, a rope or adhesive tape. By attaching the attachment means 4 to a part which is subject to some kind of movement in the case of an accident (e.g. an air-bag or some means connected to an air-bag) the radiating structure 20 will be folded up to some extent, in order to provide an antenna which can radiate on plural frequencies, in order to transmit emergency signals. Alternatively the radiating structure 20 can be stored in a compartment having a lid that opens in the case of an accident, so that the antenna can fall out and become operative. The radiating structure 20 could also be made somewhat stiff, so that a spring force will be applied to the radiating structure 20 when compressing it, and thereby possibly making it inoperative by shortcircuiting, i.e. when stowing it in said compartment. When the lid or some retaining means is released the radiating structure 20 will expand due to the spring force and put in an operative state.

This solves a big problem, since it is common in connection to for example car accidents that the ordinary antennas are damaged or set in a position unfavourable of transmission. Further, emergency signals can be transmitted on a plurality of frequencies. It is also advantageous that the antenna means has a switch-off/switch-on function, so that the antenna can be made inoperative when not needed and made operative when to be used for transmission.

Figure 10:
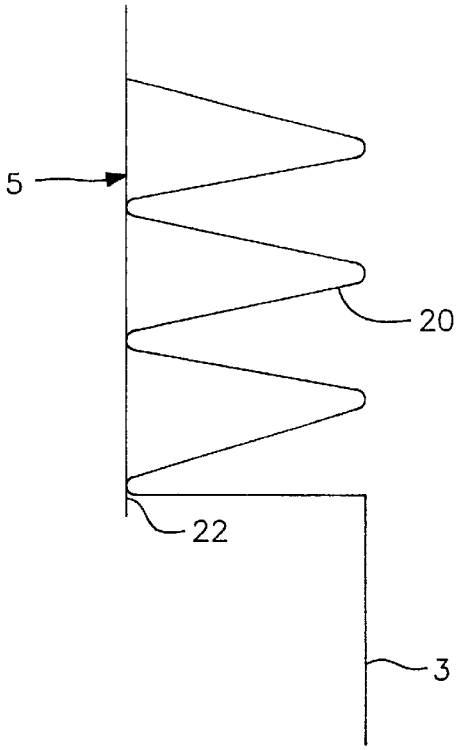
FIG. 10 is a diagrammatic side view of a radiating structure according to the invention, which is to be used in a further embodiment of an emergency antenna.

FIG. 10 shows a radiating structure 20 according to the invention, which is to be used in a further embodiment of an emergency antenna. The radiating structure 20 is made stiff and self supporting, and is shortcircuited at a number of bent portions by means of a conductive part 5, connecting preferably all sections. When the conductive part is removed, i.e. by a release function in the case of an accident, as in the previous embodiment, the radiating structure 20 is made operable and gets it broad band characteristics.

Figure 11:
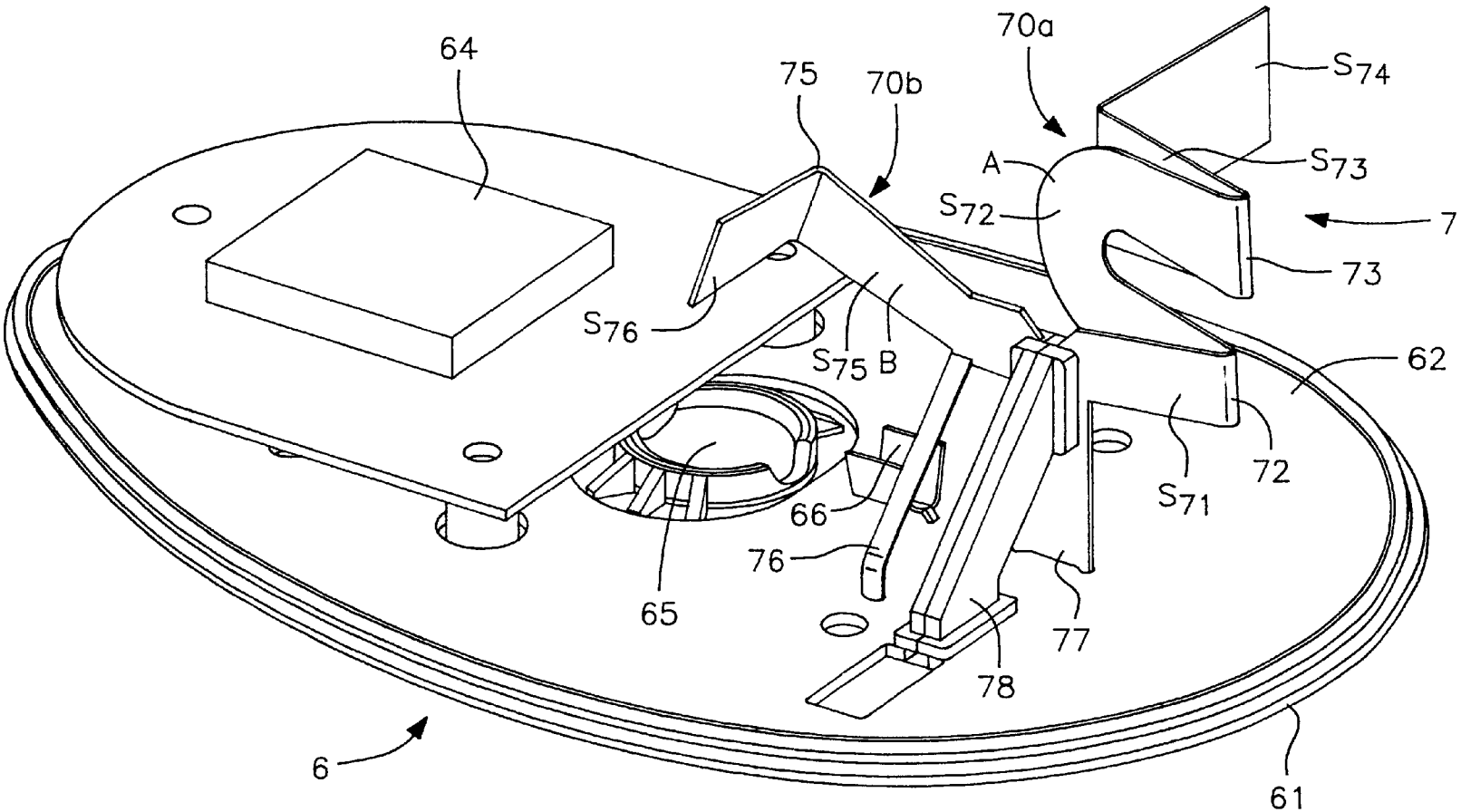
FIG. 11 shows an antenna assembly including an antenna means according to the invention.

FIG. 11 shows an antenna assembly 6 especially adapted for mounting on a vehicle body, e.g. on the roof. on a base 61 a printed circuit board (PCB) 62 is mounted. The PCB 62 acts as part of a ground plane means with its conductive portions preferably together with a conductive part, e.g. the vehicle body, on which the assembly 6 is mounted. The PCB is capacitively or conductively coupled to this conductive part.

Alternatively the PCB can be omitted, and the antenna assembly is then mounted directly on the conductive part. A GPS antenna 64 is also mounted on the base 61. In the center portion of the base 61 is a hole 65 arranged for feeding through cables. A clamp 66 is arranged on the PCB for clamping a coaxial antenna cable (not shown) and making electrical contact with the outer conductor of said cable. The center conductor of the coaxial cable is connected to the PCB. The PCB is, on the back side (not shown), covered by a ground layer having holes for mounting. However, in a region at the connection between the center conductor of the coaxial cable and the feed portion of the radiating structure 7, there is provided an interconnecting pattern separated from the ground layer. Possibly a matching means is arranged between the connection for the center conductor of the coaxial cable and the feed portion of the radiating structure 7. The assembly is covered with an upper housing portion (not shown). The radiating structure 7 is similar to what is described above, but it is adapted to multiband operation, e.g. in the 900 (optionally 800) MHz and the 1800

(optionally 1900) MHz bands. The radiating structure 7 is fed at a feed portion 77, and the electrical connections are made on the back of the PCB. The band is then branched of into two radiating structure parts 70*a* and 70*b* each being in total a $\lambda/4$ wavelength type radiator for its respective frequency band. The band of the radiating structure parts 70*a* and 70*b* has bends or curves in the portions 72, 73, 74, 75. The band has a first surface A and a second surface B, and is divided into sections $S_{71}$, $S_{72}$, $S_{73}$, $S_{74}$, $S_{75}$ by the bent portions 72, 73, 74, 75. It is bent so that the surface A in a first section $S_{71}$ faces the surface A in a second section $S_{72}$, while the surface B in the second section $S_{72}$ faces the surface B in a third section $S_{73}$, and so on. As shown, the section $S_{72}$ is essentially plane and the band is curved in a U-shape. The radiating structure part 70*b* is provided with a grounding strip 76, which is connected to the ground plane means of the PCB 62. This grounding strip 76 serves as an inductor to ground and is used for the matching mainly the radiating structure part 70*b*, which essentially operates in the higher frequency band. Alternatively, the grounding strip 76 can be replaced by a grounding means including a first connection portion for connection to the radiating structure 7, a second connection portion for connection to the ground plane means of the PCB 62 and a matching means connected between said first and second connection portions. Said matching means can include inductive and/or capacitive element(s), and can be in the form of a matching circuit with discrete components. For supporting the radiating structure 7, a strut 78 is attached to the radiating structure 7 and the PCB 62. The strut 78 is preferably made of dielectric material. The radiating structure of this embodiment is functionally similarly to those described in previous embodiments.

Figure 12A:
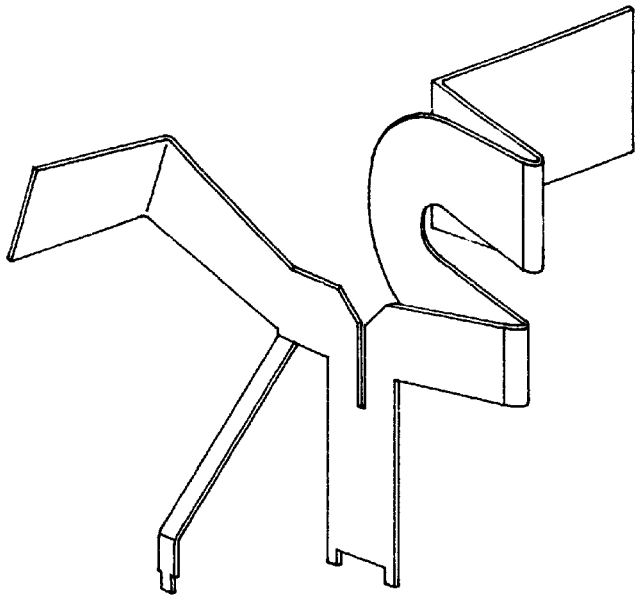
FIGS. 12*a* and 12*b* show the radiating structure of FIG. 11 in different views.
Figure 12B:
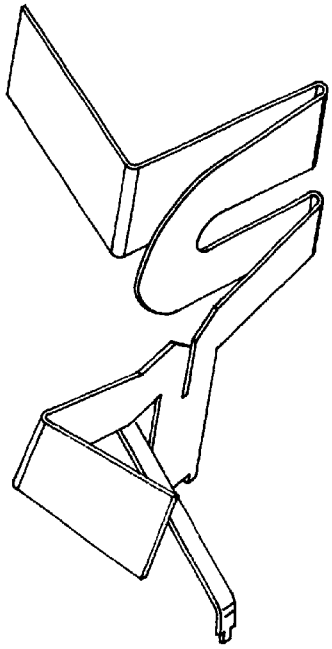
Figure 13A:
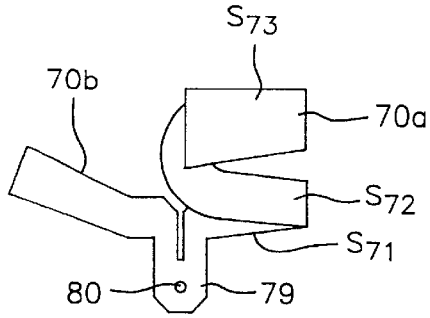
FIGS. 13*a–d* show a radiating structure according to a further embodiment of the invention in a front view, a back view, a bottom view and a side view, respectively.
Figure 13B:
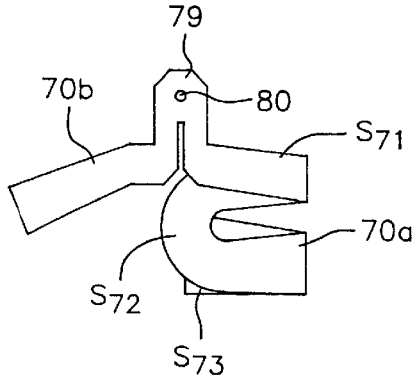
Figure 13C:
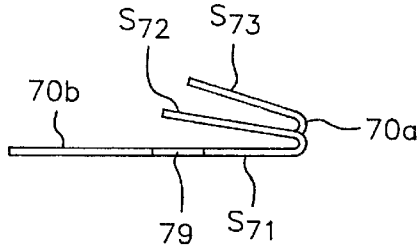
Figure 13D:
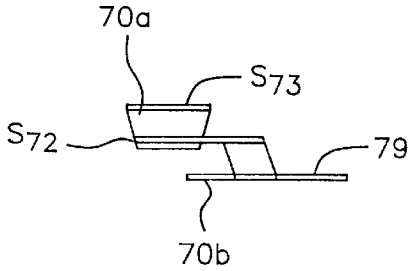

FIGS. 12*a* and 12*b* show the radiating structure of FIG. 11 in different views.

FIGS. 13*a–d* show a radiating structure according to a further embodiment of the invention. This radiating structure is similar to that included in the antenna assembly shown in FIG. 11. The feed portion 79 has a different shape, and the signal conductor or central conductor of a coaxial cable is preferably soldered at the hole 80. Further, the radiating structure part 70*b* is preferably plane and preferably in the same plane as a first section S71. The ground plane means for this radiating structure can include a conductive sheet, a printed circuit board or a conductive portion of a vehicle, or combinations thereof. Preferably the outer conductor of the coaxial cable is connected to the grounding means, which preferably is located 2–3 mm from the feed portion 79.

Figure 14:
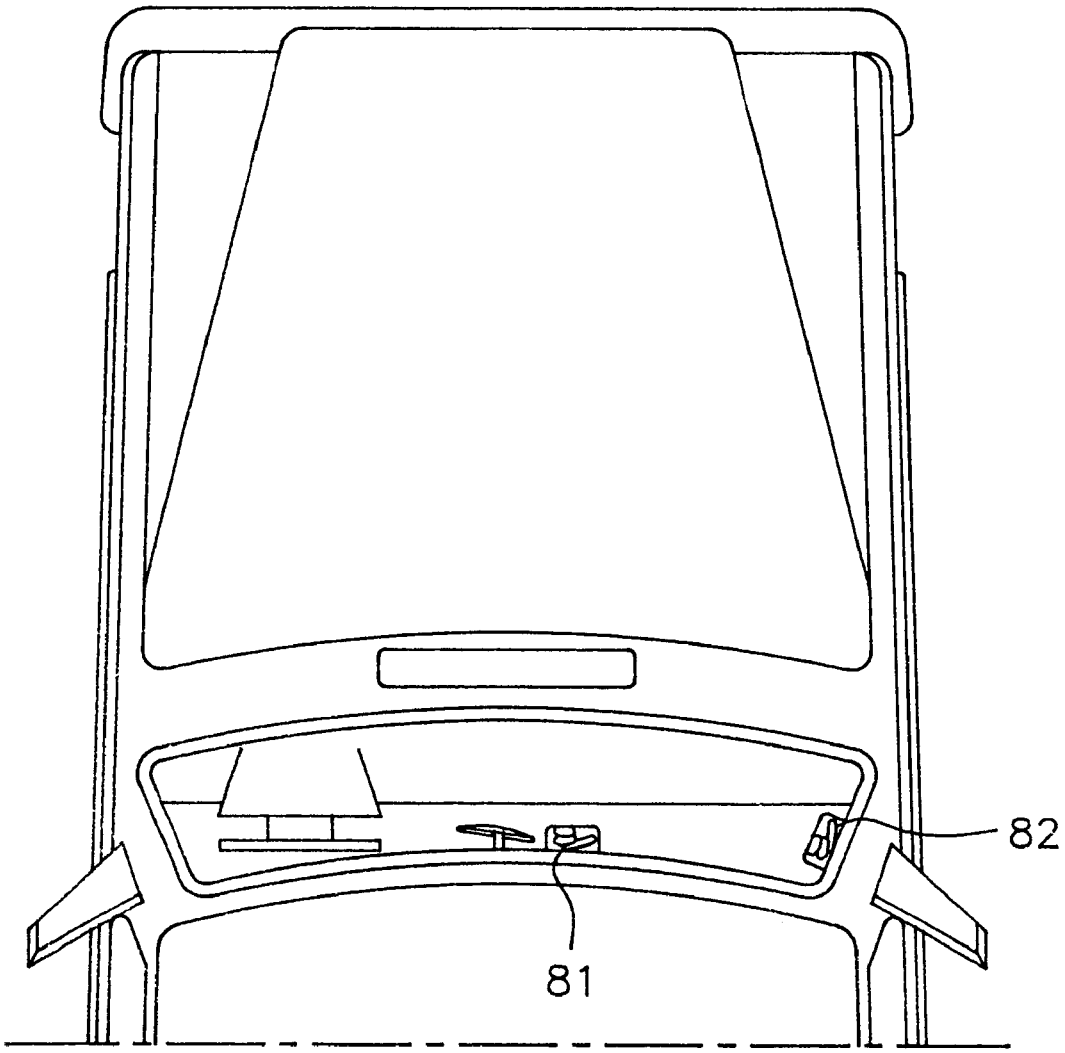
FIG. 14 shows how the radiating structure according to FIGS. 13*a–d* can be mounted on a vehicle.

In FIG. 14 it is shown how the radiating structure according to FIGS. 13*a–d* can be mounted on a vehicle. Two different locations 81 and 82 are shown, one location 81 adjacent to the inside surface of the windshield, close to an edge of the roof, and one location 82 adjacent to the inside surface of the windshield, close to an edge of a pillar. In both cases the radiating structure is mounted in a housing, and close to a conductive portion of the vehicle, which is included in the ground plane means, possibly together with a conductive sheet or a printed circuit board, as mentioned above. Other locations, e.g. at the back window, can also be suitable.

Although the invention is described by means of the above examples, naturally, many variations are possible within the scope of the invention. In the embodiments radiating structures 20 having three, four, five and seven sections have been shown. However, the number of sections could be higher, even much higher.

What is claimed is:

1. An antenna means for transmitting and receiving RF signals adapted for a mobile radio communication device comprising:

a ground plane means arranged to be connected to ground of the circuitry of a radio communication device, a conductive radiating structure having a shape of a band, the conductive radiating structure having a first A and a second B essentially parallel, closely spaced and opposed surfaces, the radiating structure having in a first end a feed portion arranged to be coupled to circuitry of the radio communication device, the radiating structure having a second end being a free end, wherein the conductive radiating structure being divided by bent portions into a number of sections along its length, the first surface A of a first section of said sections facing the first surface A of a second section of said sections, being consecutive to the first section, and the second surface B of a third section facing the surface B of a consecutive section, wherein the radiating structure has a flexibility so as to enable the radiating structure to be compressed, whereby at least two of the sections are connected to each other, in order to short-circuit the radiating structure and thus making it inoperative, and further to be expanded to disconnect the connection between the sections, in order to make the antenna means operative.

2. The antenna means according to claim 1 wherein the band is provided with a slit between each section, each of said slits extending from one edge of the band towards the opposite edge, whereby the band is conductively interrupted between the sections by the slit except for a portion adjacent to said opposite edge.

3. The antenna means according to claim 2, wherein the slits extend alternately from opposite edges of the band along the length of the band.

4. The antenna means according to claims 1, wherein the width w of the band in each section is greater than the length l of the respective section.

5. The antenna means according to claim 1, wherein the band has an increasing or decreasing width along it length.

6. An antenna means for transmitting and receiving RF signals adapted for a mobile radio communication device comprising:

a ground plane means arranged to be connected to ground of the circuitry of a radio communication device, a conductive radiating structure having a shape of a band, the conductive radiating structure having a first A and a second B essentially parallel, closely spaced and opposed surfaces, the radiating structure having in a first end a feed portion arranged to be coupled to circuitry of the radio communication device, the radiating structure having a second end being a free end, wherein the conductive radiating structure being divided by bent portions into a number of sections along its length, the first surface A of a first section of said sections facing the first surface A of a second section of said sections, being consecutive to the first section, and the second surface B of a third section facing the surface B of a consecutive section, wherein the radiating structure is stiff and made inoperable by means of a conductive member connecting preferably every section, said conducting member being removable in order to render the radiating structure operable.

7. The antenna means according to claim 6, wherein said ground plane means includes a printed circuit board providing support to said conductive radiating structure.

8. The antenna means according to claim 7, wherein said printed circuit board is capacitively coupled in said ground plane.

9. The antenna means according to claim 7, wherein said support being provided at least partly by at least one strut.

10. The antenna means according to claim, wherein at least one strut is conductive and acts as a reactive load to match said radiating structure to a desired impedance a said feed portion.

11. The antenna means according to claim 9, wherein at least one strut is non-conductive.

12. The antenna means according to claim 6, wherein the radiating structure is connected to the ground plane means via a matching means being at least one in a group consisting of a matching element with inductive characteristics and a matching element with capacitive characteristics.

13. The antenna means according to claim 12, wherein connection means for the matching means and the matching means are incorporated in a supporting strut.

14. The antenna means according to claim 12, wherein the matching means is connected to printed circuit board being a first part of the ground plane means, and being capacitively coupled to a second part of the ground plane means.

15. The antenna means according to claim 14, wherein the second part of the ground plane means includes at least a conductive portion of a vehicle body.

* * * * *